US009812276B2

(12) United States Patent
Naiman et al.

(10) Patent No.: US 9,812,276 B2
(45) Date of Patent: Nov. 7, 2017

(54) MOLDED-CASE CIRCUIT BREAKER

(71) Applicant: Siemens Aktiengesellschaft, München (DE)

(72) Inventors: Pavel Naiman, Letohrad (CZ); Milos Petracek, Letohrad (CZ); Christoph Weber, Ergoldsbach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 179 days.

(21) Appl. No.: 14/829,978

(22) Filed: Aug. 19, 2015

(65) Prior Publication Data

US 2016/0148766 A1 May 26, 2016

(30) Foreign Application Priority Data

Nov. 25, 2014 (DE) ..... 10 2014 223 998

(51) Int. Cl.
*H01H 71/04* (2006.01)
*H01H 71/52* (2006.01)

(52) U.S. Cl.
CPC ..... *H01H 71/522* (2013.01); *H01H 71/04* (2013.01)

(58) Field of Classification Search
CPC .... H01H 71/522; H01H 71/505; H01H 23/02; H01H 71/04
USPC ..... 200/43.15, 400, 43.11, 43.14, 43.16, 200/43.19, 334
See application file for complete search history.

(56) References Cited

U.S. PATENT DOCUMENTS 5,120,921 A * 6/1992 DiMarco ..... H01H 71/501 200/401
2002/0158732 A1* 10/2002 Castonguay ..... H01H 1/2058 335/172
2013/0126319 A1 5/2013 Godesa

FOREIGN PATENT DOCUMENTS

CN 103137391 A 6/2013

OTHER PUBLICATIONS

Office Action for Chinese Patent Application No. 201510593717.6 dated Jun. 21, 2017.

* cited by examiner

*Primary Examiner* — Edwin A. Leon
*Assistant Examiner* — Iman Malakooti
(74) *Attorney, Agent, or Firm* — Harness, Dickey & Pierce, P.L.C.

(57) ABSTRACT

A molded-case circuit breaker includes a handle, a contact system and an actuating device. In an embodiment, the handle is movable between an "ON" position and an "OFF" position, the contact system includes at least one stationary contact and a movable contact and the actuating device is operatively connected to the handle and the contact system such that, when the handle is actuated, it is possible to open and close the contact system. Furthermore, in the event of a fault state, the handle can be brought into a "TRIP" position arranged between the "ON" position and the "OFF" position by the actuating device.

9 Claims, 3 Drawing Sheets

MOLDED-CASE CIRCUIT BREAKER

PRIORITY STATEMENT

The present application hereby claims priority under 35 U.S.C. §119 to German patent application number DE 102014223998.2 filed Nov. 25, 2014, the entire contents of which are hereby incorporated herein by reference.

FIELD

At least one embodiment of the present invention generally relates to a molded-case circuit breaker having a handle, a contact system and an actuating device, wherein the handle is movable between an "ON" position and an "OFF" position, wherein, furthermore, the contact system has at least one stationary contact and a movable contact and wherein the actuating device is operatively connected to the handle and the contact system such that, when the handle is actuated, it is possible to open and close the contact system, and wherein, furthermore, in the event of a fault state, the handle can be brought into a "TRIP" position arranged between the "ON" position and the "OFF" position by the actuating device.

BACKGROUND

In modern engineering, molded-case circuit breakers are known and are widely used. Molded-case circuit breakers of this type enable, in particular, the switching of high currents or powers, for example currents of 70 kA or higher. In this case, molded-case circuit breakers of this type are often also designed with safety devices, for instance an overload and/or short-circuit protection device and corresponding trip switches. Thus, known molded-case circuit breakers also increase safety when switching such currents.

In this case, it is a requirement on such molded-case circuit breakers that the externally visible parts of the molded-case circuit breaker correctly indicate the internal switching state of the molded-case circuit breaker at all times in a manner visible to a user. In particular, it is an essential requirement that the molded-case circuit breaker does not indicate the interruption of a flow of current if, internally the flow of current is not interrupted, for example owing to melting of the contacts owing to an overvoltage and/or an overload. In the case of known molded-case circuit breakers, this is achieved, for example, by a handle of the molded-case circuit breaker at least not being able to be locked in an "OFF" position as soon as such a serious fault state is present.

SUMMARY

At least one embodiment of the present invention improves the above-described molded-case circuit breaker and at least partially eliminates at least one disadvantage of known molded-case circuit breakers. In particular, at least one embodiment of the invention provides a molded-case circuit breaker in which a particularly high level of safety can be provided for the user in a particularly simple and cost-effective manner.

At least one embodiment of the present invention is directed to a molded-case circuit breaker. Further features and details of the invention emerge from the claims, the description and the drawings.

A molded-case circuit breaker of an embodiment includes a handle, a contact system and an actuating device, wherein the handle is movable between an "ON" position and an "OFF" position, wherein, furthermore, the contact system has at least one stationary contact and a movable contact and wherein the actuating device is operatively connected to the handle and the contact system such that, when the handle is actuated, it is possible to open and close the contact system, and wherein, furthermore, in the event of a fault state, the handle can be brought into a "TRIP" position arranged between the "ON" position and the "OFF" position by the actuating device. A molded-case circuit breaker of an embodiment further includes a safety lock which is coupled to the handle and couplable to the actuating device such that, in the event of a locking state, wherein the locking state is a fault state, in which the at least one stationary contact and the at least one movable contact of the contact system are not separated, the handle is prevented from moving from the "TRIP" position into the "OFF" position by the safety lock via the coupling to the actuating device.

An embodiment of the invention is directed to a safety lock which is coupled to the handle. The safety lock is designed such that it is couplable to the actuating device in the event of a locking state such that the handle is prevented from moving from the "TRIP" position into the "OFF" position. Such a coupling can in this case be formed, for example, by form-fitting contact being made with a section of the actuating device by a part of the safety lock.

BRIEF DESCRIPTION OF THE DRAWINGS

A molded-case circuit breaker according to an embodiment of the invention and the developments and advantages thereof are explained in more detail below with reference to the drawings, in which.

Figure 2:
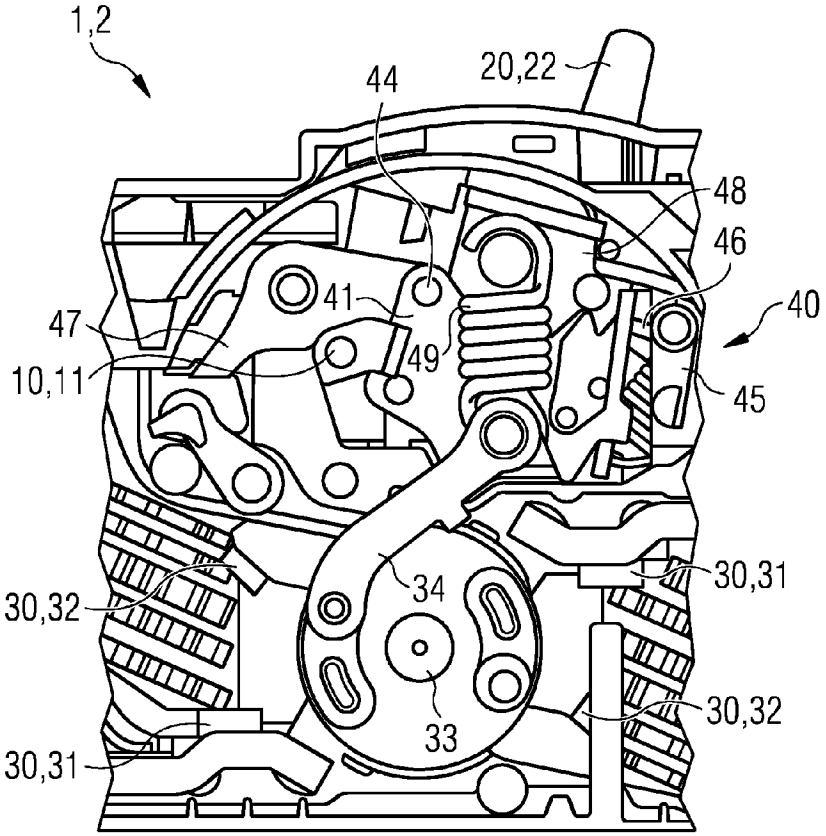

Elements having identical functions and modes of operation are in this case each provided with identical reference signs.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A molded-case circuit breaker of an embodiment includes a handle, a contact system and an actuating device, wherein the handle is movable between an "ON" position and an "OFF" position, wherein, furthermore, the contact system has at least one stationary contact and a movable contact and wherein the actuating device is operatively connected to the handle and the contact system such that, when the handle is actuated, it is possible to open and close the contact system, and wherein, furthermore, in the event of a fault state, the handle can be brought into a "TRIP" position arranged between the "ON" position and the "OFF" position by the actuating device. A molded-case circuit breaker of an embodiment further includes a safety lock which is coupled to the handle and couplable to the actuating device such that, in the event of a locking state, wherein the locking state is a fault state, in which the at least one stationary contact and the at least one movable contact of the contact system are not separated, the handle is prevented from moving from the "TRIP" position into the "OFF" position by the safety lock via the coupling to the actuating device.

By way of a molded-case circuit breaker according to an embodiment of the invention, it is made possible to safely close a circuit, in particular a circuit in which high currents flow, and open it again. For this purpose, a user of the molded-case circuit breaker can move the handle of the molded-case circuit breaker between an "ON" position and an "OFF" position.

In the interior of the molded-case circuit breaker, the flow of current is closed or interrupted by a contact system. For this purpose, the contact system has at least one stationary contact and a movable contact. These may be arranged, for example, in a rotor shaft.

It goes without saying that a plurality of stationary and movable contacts may also be provided in the molded-case circuit breaker, as a result of which, for example, a plurality of phases may also be switched, in particular at the same time. An actuating device is arranged in the interior of the molded-case circuit breaker for a connection between the handle and the contact system.

The actuating device is in this case operatively connected both to the handle and to the contact system such that, firstly, it is possible to open and close the contact system when the handle is actuated and, secondly, in the event of a fault state, for example in the event of an overload, an overcurrent or a short-circuit current in the downstream circuit, this is indicated by the actuating device, in particular, for example, by a corresponding trip switch, by transferring the handle from the "ON" position to a "TRIP" position arranged between the "ON" position and the "OFF" position. At the same time, in the event of a fault state, the actuating device acts on the contact system in such a manner that, if possible, the contacts of the contact system are separated and hence the flow of current is interrupted.

In the event of a trip state, the separation is possible. The handle of the molded-contact circuit breaker can subsequently be brought out of the "TRIP" position into the "OFF" position by the user, as a result of which the actuating device and/or the contact system are reset in the interior of the molded-case circuit breaker. The molded-case circuit breaker is then, in particular, fully operational again.

In addition to a trip state, a locking state may also be present as fault state, however. In such a locking state, the at least one stationary contact and the at least one movable contact of the contact system are not separated, even after the fault state has been identified and the handle has been brought into its "TRIP" position by the actuating device. This can be due, for example, to the fact that the stationary contact and the movable contact of the contact system are materially integrally connected, for example welded and/or melted, to one another by an overload or a short-circuit current. A movement of the handle from the "TRIP" position into the "OFF" position by a user, and in particular blocking of the handle in the "OFF" position must be reliably prohibited in this case since, otherwise, a molded-case circuit breaker which is switched off would be indicated externally although the circuit in the interior of the molded-case circuit breaker has not been interrupted.

An embodiment of the invention is directed to a safety lock which is coupled to the handle. The safety lock is designed such that it is couplable to the actuating device in the event of a locking state such that the handle is prevented from moving from the "TRIP" position into the "OFF" position. Such a coupling can in this case be formed, for example, by form-fitting contact being made with a section of the actuating device by a part of the safety lock.

Provision may also be made that, in the event of a normal state which is present during fault-free operation of the molded-case circuit breaker, the coupling of the safety lock to the actuating device is not present. It is therefore possible to reliably avoid influencing the function of the actuating device in the event of a normal state.

In the event of a locking state, the actuating device is also at least partially blocked owing to the fact that the stationary contact and the movable contact are not separated and also not separable. Owing to the coupling of the safety lock to the actuating device, in the event of a locking state, the function and particularly the movement of the handle are restricted to the extent that an attempt by the user of the molded-case circuit breaker to move the handle from its "TRIP" position to the "OFF" position cannot be made. As a result, a false indication of a separated circuit, visible by the handle in its "OFF" position, can be reliably prevented.

As a result of this, it is clearly visible to the user that a locking state is present, in which, in particular, in the interior of the molded-case circuit breaker at least one stationary contact and a movable contact of the contact system are connected to one another and thus the downstream circuit is still closed. The user can then take the necessary precautions, for example for exchanging the molded-case circuit breaker. The safety for the user when using a molded-case circuit breaker according to an embodiment of the invention can therefore be increased overall.

Furthermore, in the case of a molded-case circuit breaker according to an embodiment of the invention, provision may be made that, in the event of a trip state, wherein the trip state is a fault state, in which the at least one stationary contact and the at least one movable contact of the contact system are separated, the safety lock supports a reset of the actuating device and/or of the contact system when the handle is moved from the "TRIP" position into the "OFF" position. As already mentioned above, in the event of a trip state, the actuating device and/or the contact system may be reset by a movement of the handle from the "TRIP" position to the "OFF" position.

The actuating device and/or the contact system are in this case set into a state which corresponds to the state of the actuating device and/or the contact system in the normal state of the molded-case circuit breaker. In this case, provision may be made, for example, for a trip mechanism as part of the actuating device to be reset, in particular. In addition, springs and/or snap-action devices, which are present, for example, in a rotor of the contact system, may also be reset.

In the event of a trip state, the contacts of the contact system are separated by the actuating device. Such a separation may lead to contaminants in the interior of the molded-case circuit breaker, for example by way of an arc occurring when the contacts are opened. The contaminants may impair the actuating device and/or the contact system, in particular the mechanism in the interior of a rotor of the contact system, such that both tripping in the event of a trip state and resetting the molded-case circuit breaker are prevented.

Therefore, provision may advantageously be made for the safety lock to support the reset process when the handle is moved from the "TRIP" position into the "OFF" position. This may be achieved, for example, by form-fitting contact being made between the safety lock and a region of the actuating device. Resetting of the actuating device and/or of the contact system can therefore be significantly simplified.

Additional energy sources for overcoming the additional friction caused by contaminants in the interior of the molded-case circuit breaker, for instance spring elements, can be saved or at least reduced in size as a result. A simpler configuration of a molded-case circuit breaker can be enabled as a result.

Particularly preferably, a molded-case circuit breaker according to an embodiment of the invention can be designed such that the actuating device has a knee lever and the safety lock has a locking bolt, wherein the knee lever is movably mounted, wherein, furthermore, the locking bolt is mechanically operatively connected to the handle of the contact system and, in the event of a locking state, is operatively connected to the knee lever such that a movement of the handle from the "TRIP" position to the "OFF" position is prevented. The knee lever is in this case preferably a component of the actuating device which is mechanically operatively connected, for example via a switching spring, to the handle and thus likewise performs a movement in the interior of the molded-case circuit breaker in the event of a movement of the handle. This can be ensured owing to the movable mounting of the knee lever.

Furthermore, the knee lever as part of the actuating device is also mechanically operatively connected to the contact system which is immovable in the locking state. As a result of this, in particular, provision may preferably be made for a movement of the knee lever in the event of a locking state to be blocked. The locking bolt, which as part of the safety lock is mechanically operatively connected to the handle, can likewise be prevented from moving in the event of a locking state by the mechanical operative connection to the knee lever, as a result of which a movement of the handle is also preventable. Owing to such a locking bolt, a safety lock of a molded-case circuit breaker according to the invention can be designed to be particularly simple as a result.

In a development of a molded-case circuit breaker according to an embodiment of the invention, provision may further be made for the knee lever to be rotatably mounted about a lever pivot. Such mounting about a pivot and, in particular, the rotational movement enabled thereby is a particularly simple movable mounting of the knee lever. In particular, such a rotational movement can also be particularly easily blocked in the event of a locking state. The mechanical construction of a molded-case circuit breaker according to the invention can be simplified even further as a result.

In addition, a molded-case circuit breaker according to an embodiment of the invention may be designed in another development such that, in the event of a locking state, the locking bolt makes contact with a first region of the knee lever. The first region of the knee lever may in this case be, in particular, an edge region and/or a rim of the knee lever. As part of the actuating device, the knee lever is mechanically operatively connected to the movable contact of the contact system. In particular, provision may in this case be made for the knee lever to be arranged in a stationary and immovable manner in the interior of the molded-case circuit breaker in the event of a locking state. Owing to the locking bolt making contact with a first region of the knee lever, a movement of the locking bolt and hence the handle can thus be particularly easily prevented.

Moreover, in the case of a molded-case circuit breaker according to an embodiment of the invention, provision may also be made that, in the event of a trip state, the locking bolt makes contact with a second region of the knee lever. In the event of a trip state, the movable contact and the stationary contact of the contact system are separated and the handle is in its "TRIP" position. By moving the handle into its "OFF" position, the user can reset the actuating device of the molded-case circuit breaker.

A trip state may, as mentioned above, lead to internal contamination, particularly of the actuating device and/or of the contact system of the molded-case circuit breaker, as a result of which the resetting can be complicated or even completely no longer able to be performed. By the locking bolt making contact with a second region of the knee lever, which likewise may be designed as an end face and/or a rim of the knee lever, a movement of the handle can be transferred via the locking bolt to the knee lever.

Owing to the mechanical operative connection of the locking bolt and the actuating device, which is operative in addition to the normally present mechanical operative connection, for example by a switching spring mechanically connected to the handle and/or by an actuating lever, an improved mechanical operative connection results, in particular directly between the handle and the actuating device. Thus, in particular, as a result of the fact that a mechanical influence can be exerted on the actuating device from two different sides at the same time, what can be achieved is that the resetting of the actuating device and/or of the contact system of the molded-case circuit breaker is particularly easily supported.

According to a particularly preferred development, a molded-case circuit breaker according to an embodiment of the invention can further be designed such that the first region and the second region are arranged at an angle between 0° and 15°, preferably between 5° and 10°. As a result of this, the knee lever of the actuating device of a molded-case circuit breaker according to the invention can be particularly simply designed.

In particular, an arrangement of the two regions with respect to one another can be selected such that a resultant force which is exerted by the locking bolt on the knee lever is directed such that a movement of the locking bolt in the event of a locking state is prevented and such that the movement of the knee lever is supported by the locking bolt in the event of a trip state. Thus, for example, when a lever pivot is present, the force is directed such that it points from the contact point of the locking bolt at the respective region of the knee lever in a direction below the lever pivot. This can be achieved particularly easily by such an angle between the two regions which is between 0° and 15°, preferably between 5° and 10°.

Figure 1:
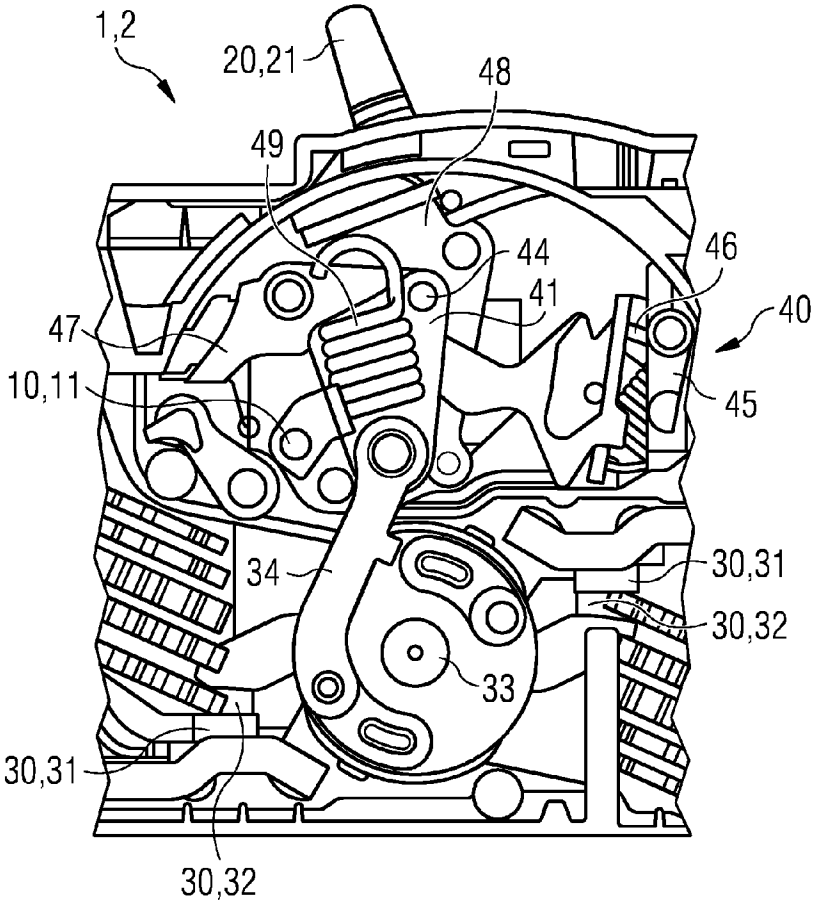
FIG. 1 schematically shows a molded-case circuit breaker according to an embodiment of the invention in the normal state, FIG. 2 schematically shows a molded-case circuit breaker according to an embodiment of the invention in the normal state, FIG. 3 schematically shows a molded-case circuit breaker according to an embodiment of the invention in the trip state, FIG. 4 schematically shows a molded-case circuit breaker according to an embodiment of the invention in the locking state, FIG. 5 schematically shows a locking bolt and a knee lever of a molded-case circuit breaker according to an embodiment of the invention, and FIG. 6 schematically shows a locking bolt and a knee lever of a molded-case circuit breaker according to an embodiment of the invention.

FIGS. 1 and 2 each show a molded-case circuit breaker 1 according to the invention in the normal state 2. In this case, the molded-case circuit breaker 1 is illustrated in the switched-on state in FIG. 1 and in the switched-off state in FIG. 2.

In FIG. 1, the handle 20 is in its "ON" position 21 and the stationary contact 31 and the movable contact 32 of the contact system 30 are closed. In contrast, in FIG. 2, the handle 20 is in its "OFF" position 22 and the stationary contact 31 and the movable contact 32 of the contact system 30 are open. The contact system 30 is illustrated with only one contact pair, consisting of a stationary contact 31 and a movable contact 32 which are arranged in a rotor 33. It goes without saying that a molded-case circuit breaker 1 according to an embodiment of the invention may also have a plurality of such contact pairs. A connecting link 34 is arranged on the rotor 33 of the contact system 30, which connecting link enables a mechanical operative connection to the actuating device 40.

In addition to various mechanical elements, for example a trip shaft 45, a latch 46, a clamping lever 47 and an actuating lever 48, said actuating device 40 also has, in particular, a knee lever 41. The knee lever 41 is rotatably mounted about a lever pivot 44 and is in turn mechanically operatively connected firstly via a switching spring 49 to the handle 20 of the molded-case circuit breaker 1 and secondly via a connecting link 34 to the rotor 33 of the contact system 30. In this case, a movement of the knee lever 41 is directly coupled, in particular, via the switching spring 49 to a movement of the handle 20 and, conversely, a movement of the handle 20 is coupled to a movement of the knee lever 41.

Furthermore, a locking bolt 11 as part of a safety lock 10 is shown in FIGS. 1 and 2. The locking bolt 11 is in turn mechanically operatively connected to the handle 20, in particular via the actuating lever 48. In the depicted normal state 2, said locking bolt 11 in the molded-case circuit breaker 1 is arranged remote from the knee lever 41. There is therefore no operative connection between the locking bolt 11 and the knee lever 41 in the normal state 2 of the molded-case circuit breaker 1.

Figure 3:
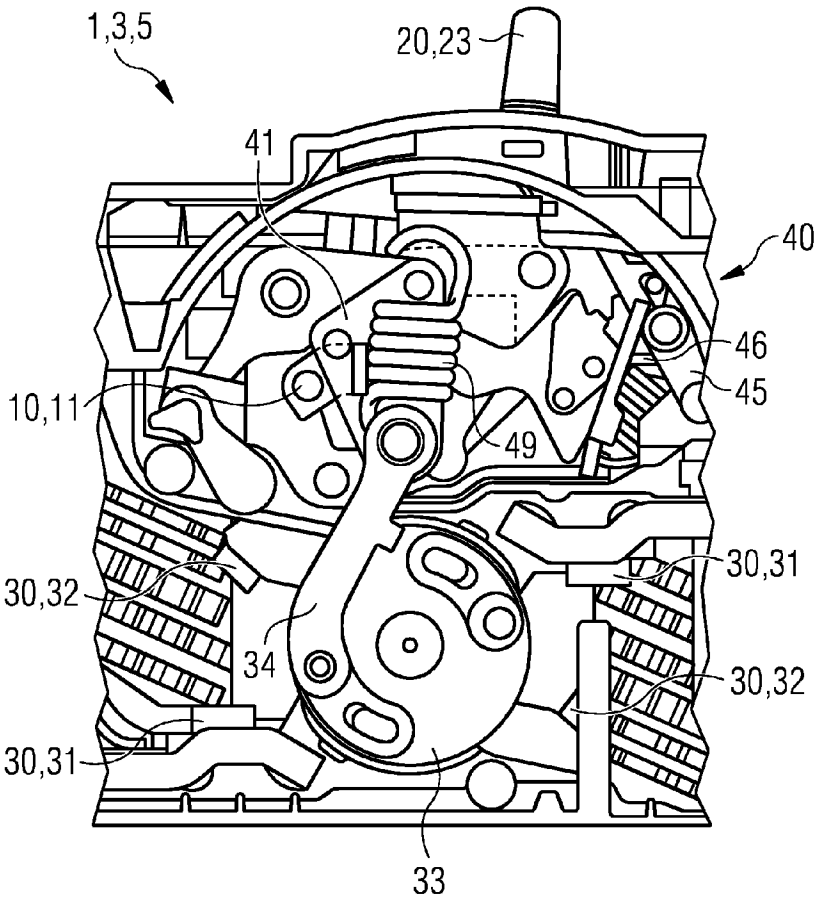

This changes if the molded-case circuit breaker 1 is in a fault state 3. This is shown in FIG. 3, in which the fault state 3 is a trip state 5. In the event of a fault state 3, for example, an overvoltage, an overload and/or a short-circuit current have/has occurred in the downstream circuit.

By elements of the actuating device 40, for instance a trip switch (not illustrated), the molded-case circuit breaker 1 can react to such overloads and, as shown in the figures, separate the stationary contact 31 and the movable contact 32 of the contact system 30. Thus, the circuit equipped with the molded-case circuit breaker 1 can automatically be switched so as to be free of current and, as a result, the safety for a user can be increased.

In order to indicate the presence of a fault state 3 to the user, at the same time as the separation of the contact system 30, the handle 20 is brought into its "TRIP" position 23 by the actuating device 40. Thus, it is externally visible to the user that the molded-case circuit breaker 1 is in a fault state 3.

Before it is possible to switch the molded-case circuit breaker 1 on again, it must be reset, in particular the actuating device 40 and/or the contact system 30 in the interior of the molded-case circuit breaker 1 must be reset. In this case, for example, the trip shaft 45 and the latch 46, which are shifted during tripping, are moved back into their starting positions. In addition, springs and snap-action devices (not illustrated) which may be arranged in the interior of the rotor 33 of the contact system 30 can be reset here. This occurs by the handle 20 being brought out of the "TRIP" position 23 and into the "OFF" position 22 (not illustrated) by the user.

However, in the case of a trip process such as this, contaminants may enter the interior of the molded-case circuit breaker 1, for example caused by an arc between the stationary contact 31 and the movable contact 32, which arc can form when the contact system 30 is suddenly opened. The trip process and also the resetting of the actuating device 40 and/or the contact system 30 can be prevented and/or at least complicated by said contaminants.

In a molded-case circuit breaker according to an embodiment of the invention, a locking bolt 11 as part of a safety lock 10 is provided, which locking bolt is in particular directly mechanically operatively connected to the handle 20. In the trip state 5, the locking bolt 11 abuts the knee lever 41 such that the resetting of the actuating device 40 and/or the contact system 30 is supported by a movement of the handle 20 from the "TRIP" position 23 into the "OFF" position 22. This is enabled, in particular, by the fact that the movable contact 32 is separated from the stationary contact 31 in the trip state 5 and is thus movable, wherein, by means of the mechanical operative connection via the connecting link 34, the knee lever 41 with which the locking bolt 11 has made contact is also movable. As a result of this, it is particularly simple to be able to overcome frictional forces which are caused by the contaminants.

Figure 4:
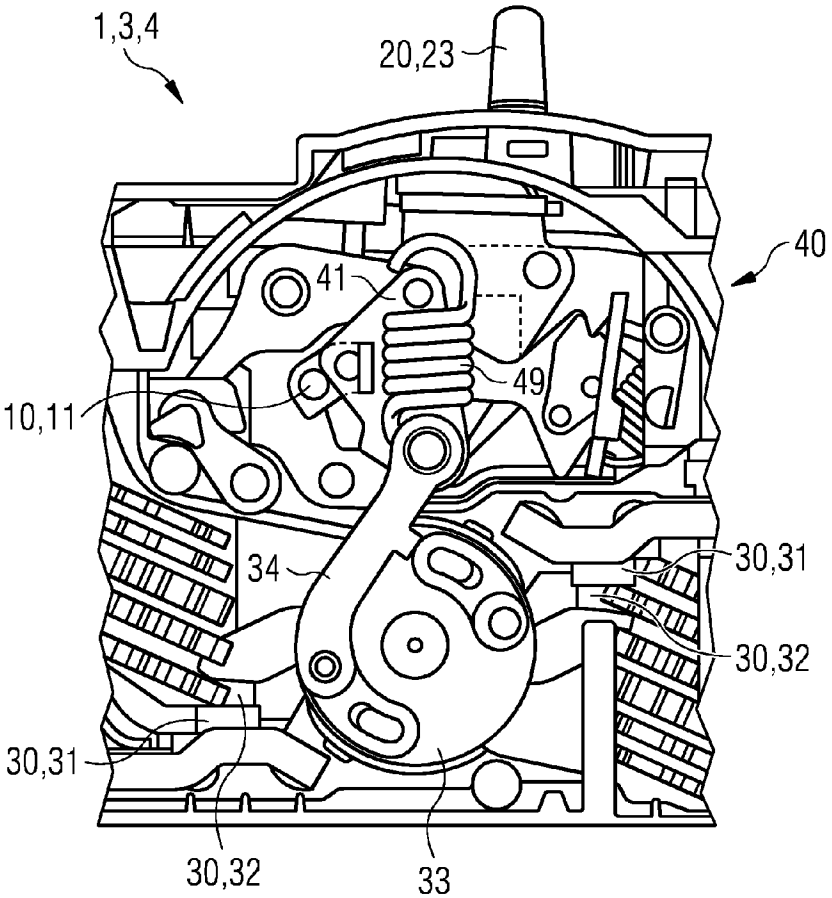

Another possible fault state 3 of the molded-case circuit breaker 1 is shown in FIG. 4. In contrast to FIG. 3, in this case a locking state 4 is present in which the stationary contact 31 and the movable contact 32 have not been separated. This may occur, for example in the event of an overload or a short-circuit current, by melting or welding of the stationary contact 31 and the movable contact 32. A locking state 4 is therefore a significantly more dangerous fault state 3 since current is still flowing or at least current can flow through the closed contact system 30.

In particular, what must also be prevented is that the handle 20 is brought from its "TRIP" position 23 into its "OFF" position 22 (not illustrated) by the user since, otherwise, there would be the risk that the molded-case circuit breaker 1 would be perceived to be switched off although the contact system 30 in the interior is still closed. For this purpose, the locking bolt 11 already described above of the safety lock 10 is provided in a molded-case circuit breaker 1 according to an embodiment of the invention. The locking bolt 11 is in particular directly mechanically operatively connected to the handle 20.

Furthermore, the locking bolt 11 is arranged such that it makes contact with the knee lever 41 of the actuating device 40. Owing to the fact that the movable contact 32 and the stationary contact 31 are not separable and thus not movable, the knee lever 41 which is mechanically operatively connected to the contact system 30 via the connecting link 34 is also not movable. Thus, a movement of the locking bolt 11 is prevented by the knee lever 41. Since the locking bolt 11 is directly mechanically operatively connected to the handle 20 via the connection via the actuating lever 48, the handle 20 can thus also not be brought out of the "TRIP" position 23 into the "OFF" position 22. As a result, the safety for the user of a molded-case circuit breaker 1 according to an embodiment of the invention can be increased in a particularly simple manner.

Figure 5:
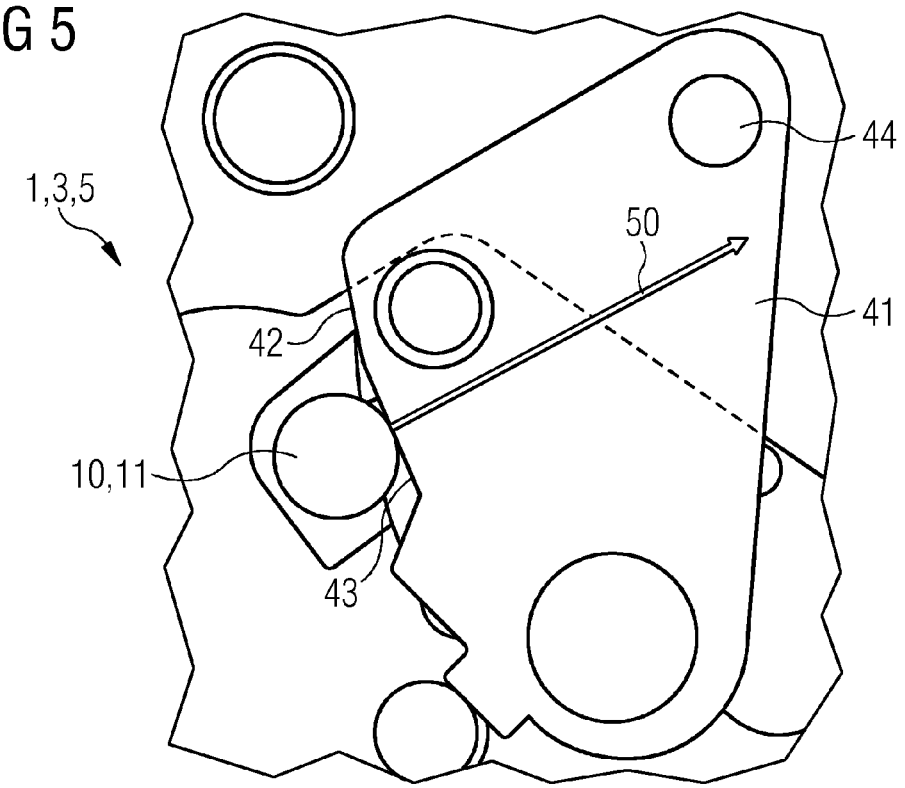
Figure 6:
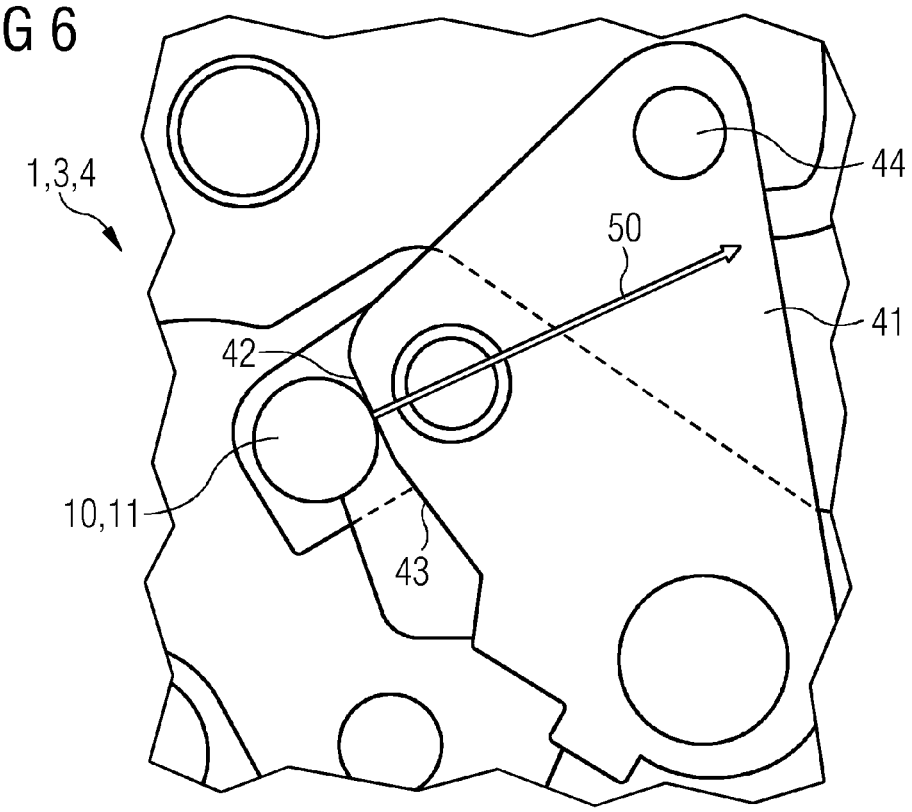

FIGS. 5 and 6 each show the knee lever 41 and the locking bolt 11, wherein the molded-case circuit breaker 1 is in a trip state 5 in FIG. 5 and in a locking state 4 in FIG. 6. It can clearly be seen that the locking bolt 11 of the safety lock 10 is arranged differently with respect to the knee lever 41 in the individual fault states 3 of the molded-case circuit breaker 1. Thus, in the event of a trip state 5, the locking bolt 11 makes contact with a second region 43 of the knee lever 41 (FIG. 5) and, in the event of a locking state 4, makes contact with a first region 42 of the knee lever 41 (FIG. 6). The first 42 and the second 43 regions are in this case designed in the shown embodiment as edge regions, in particular as rims, of the knee lever 41.

Furthermore, the two regions 42, 43 are arranged at a small angle, preferably between 5° and 10°, with respect to one another. As a result, it is particularly simple to ensure that a resultant force 50 which acts at the contact point between the locking bolt 11 and the knee lever 41 is always directed such that it points from the contact point of the locking bolt 11 at the respective region 42, 43 of the knee lever 41 in a direction below the lever pivot 44. As a result of this, it can be ensured in a particularly simple manner that a movement of the knee lever 41 is prevented in the event of a locking state 4 and is supported in the event of a trip state 5.

LIST OF REFERENCE SIGNS

1 molded-case circuit breaker
2 normal state

3 fault state
4 locking state
5 trip state
10 safety lock
11 locking bolt
20 handle
21 "ON" position
22 "OFF" position
23 "TRIP" position
30 contact system
31 stationary contact
32 movable contact
33 rotor
34 connecting link
40 actuating device
41 knee lever
42 first region
43 second region
44 lever pivot
45 trip shaft
46 latch
47 clamping lever
48 actuating lever
49 switching spring
50 resultant force

What is claimed is:

1. A molded-case circuit breaker, comprising:

a handle, movable between an "ON" position and an "OFF" position;

a contact system, including at least one stationary contact and a movable contact;

an actuating device, operatively connected to the handle and the contact system such that, when the handle is actuated, the contact system is openable and closeable, wherein, in an event of a fault state, the handle is movable into a "TRIP" position arranged between the "ON" position and the "OFF" position via the actuating device; and a safety lock, coupled to the handle and couplable to the actuating device such that, in the event of a locking state, the locking state being a fault state, in which the at least one stationary contact and the at least one movable contact of the contact system are not separated, the handle is prevented from moving from the "TRIP" position into the "OFF" position by the safety lock, via the coupling to the actuating device, wherein the actuating device includes a knee lever and the safety lock includes a locking bolt, wherein the knee lever is movably mounted, and wherein the locking bolt is mechanically operatively connected to the handle of the contact system and, in the event of a locking state, is operatively connected to the knee lever such that movement of the handle from the "TRIP" position to the "OFF" position is prevented, wherein, in the event of a locking state, the locking bolt makes contact with a first region of the knee lever, wherein, in the event of a trip state, the locking bolt makes contact with a second region of the knee lever.

2. The molded-case circuit breaker of claim 1, wherein, in the event of a trip state, the trip state being a fault state, in which the at least one stationary contact and the at least one movable contact of the contact system are separated, the safety lock supports a reset of at least one of the actuating device and the contact system when the handle is moved from the "TRIP" position into the "OFF" position.

3. The molded-case circuit breaker of claim 1, wherein the knee lever is rotatably mounted about a lever pivot.

4. The molded-case circuit breaker of claim 1, wherein the first region and the second region are arranged at an angle between 0° and 15°.

5. The molded-case circuit breaker of claim 4, wherein the first region and the second region are arranged at an angle between 5° and 10°.

6. The molded-case circuit breaker of claim 1, wherein the first and the second regions are edges of the knee lever.

7. A safety lock for molded-case circuit breaker including a handle, movable between an "ON" position and an "OFF" position; a contact system, including at least one stationary contact and a movable contact; and an actuating device, operatively connected to the handle and the contact system such that, when the handle is actuated, the contact system is openable and closeable, wherein, in an event of a fault state, the handle is movable into a "TRIP" position arranged between the "ON" position and the "OFF" position via the actuating device, the safety lock being coupled to the handle and being couplable to the actuating device such that, in the event of a locking state, the locking state being a fault state, in which the at least one stationary contact and the at least one movable contact of the contact system are not separated, the handle is prevented from moving from the "TRIP" position into the "OFF" position by the safety lock, via the coupling to the actuating device, wherein the actuating device includes a knee lever, wherein the safety lock includes a locking bolt, and wherein the knee lever is movably mounted, and wherein the locking bolt is mechanically operatively connected to the handle of the contact system and, in the event of a locking state, is operatively connected to the knee lever such that movement of the handle from the "TRIP" position to the "OFF" position is prevented, wherein, in the event of a locking state, the locking bolt makes contact with a first region of the knee lever, wherein, in the event of a trip state, the locking bolt makes contact with a second region of the knee lever.

8. The safety lock of claim 7, wherein the knee lever is rotatably mounted about a lever pivot.

9. The safety lock of claim 7, wherein the first and the second regions are edges of the knee lever.

* * * * *